United States Patent [19]

Ueda

[11] 4,192,409

[45] Mar. 11, 1980

[54] CLUTCH MECHANISM FOR WINCH

[75] Inventor: Masao Ueda, Komatsu, Japan

[73] Assignee: Kabushiki Kaisha Komatsu Seisakusho, Tokyo, Japan

[21] Appl. No.: 792,976

[22] Filed: May 2, 1977

[30] Foreign Application Priority Data

Apr. 30, 1976 [JP] Japan ..... 51-48479

[51] Int. Cl.[2] ..... B60K 41/26; F16H 57/10

[52] U.S. Cl. ..... 192/4 R; 74/764; 74/768

[58] Field of Search ..... 74/753, 764, 765, 770, 74/768, 769; 192/4 R

[56] References Cited

U.S. PATENT DOCUMENTS

| | | | |
|---|---|---|---|
| 2,891,767 | 6/1959 | Armington | 74/764 |
| 2,927,669 | 3/1960 | Walerowski | 172/4 R |
| 3,039,327 | 6/1962 | Breting | 74/764 |
| 3,905,252 | 9/1975 | Zaiser | 74/753 |

*Primary Examiner*—Allan D. Herrmann
*Attorney, Agent, or Firm*—Armstrong, Nikaido, Marmelstein & Kubovcik

[57] ABSTRACT

A clutch mechanism for winch comprising first and second planetary gear sets mounted on an input shaft so as to selectively connect an output shaft with said input shaft in the same or opposite direction of rotation. The clutch mechanism also includes a brake mounted on said output shaft, said brake normally acting on said output shaft so that the output shaft cannot be rotated.

5 Claims, 2 Drawing Figures

CLUTCH MECHANISM FOR WINCH

BACKGROUND OF THE INVENTION

This invention relates to a winch and more particularly to a clutch mechanism for use in a winch.

Heretofore an intermediate power transmission unit is arranged between a power input and a winch drum driving unit. The intermediate power transmission unit generally comprises a clutch which connects an input shaft with an output shaft in the same direction of rotation, another clutch connecting the input shaft with the output shaft in the opposite direction, a brake, and a jaw clutch which makes the overall winch structure complicated and bulky.

SUMMARY OF THE INVENTION

It is, therefore, an object of the present invention to provide a winch having an improved clutch mechanism.

Another object of the present invention is to provide a winch wherein intermediate transmission units can be ommitted to make the overall winch structure compact.

According to the present invention, there is provided a clutch mechanism for winch comprising a clutch housing, an input shaft rotatably supported within said clutch housing, an output shaft rotatably supported within said clutch housing coaxially with said input shaft, a first planetary gear set mounted on said input shaft adapted to rotatably connect said input shaft with said output shaft in the same direction, a second planetary gear set mounted on said input shaft adapted to rotatably connect said input shaft with said output shaft in the opposite direction, and braking means mounted on said output shaft wherein said first and second planetary gear sets are selectively operated so as to transmit input rotation to said output shaft in the same or opposite direction.

With the improved clutch mechanism in the place of complicated intermediate transmission units, it is possible to make the overall winch structure compact. Other objects, features and advantages of the present invention will be readily apparent from the following description taken in conjunction with the accompanying drawings.

DETAILED DESCRIPTION OF THE PREFERRED EMBODIMENT

Figure 1:
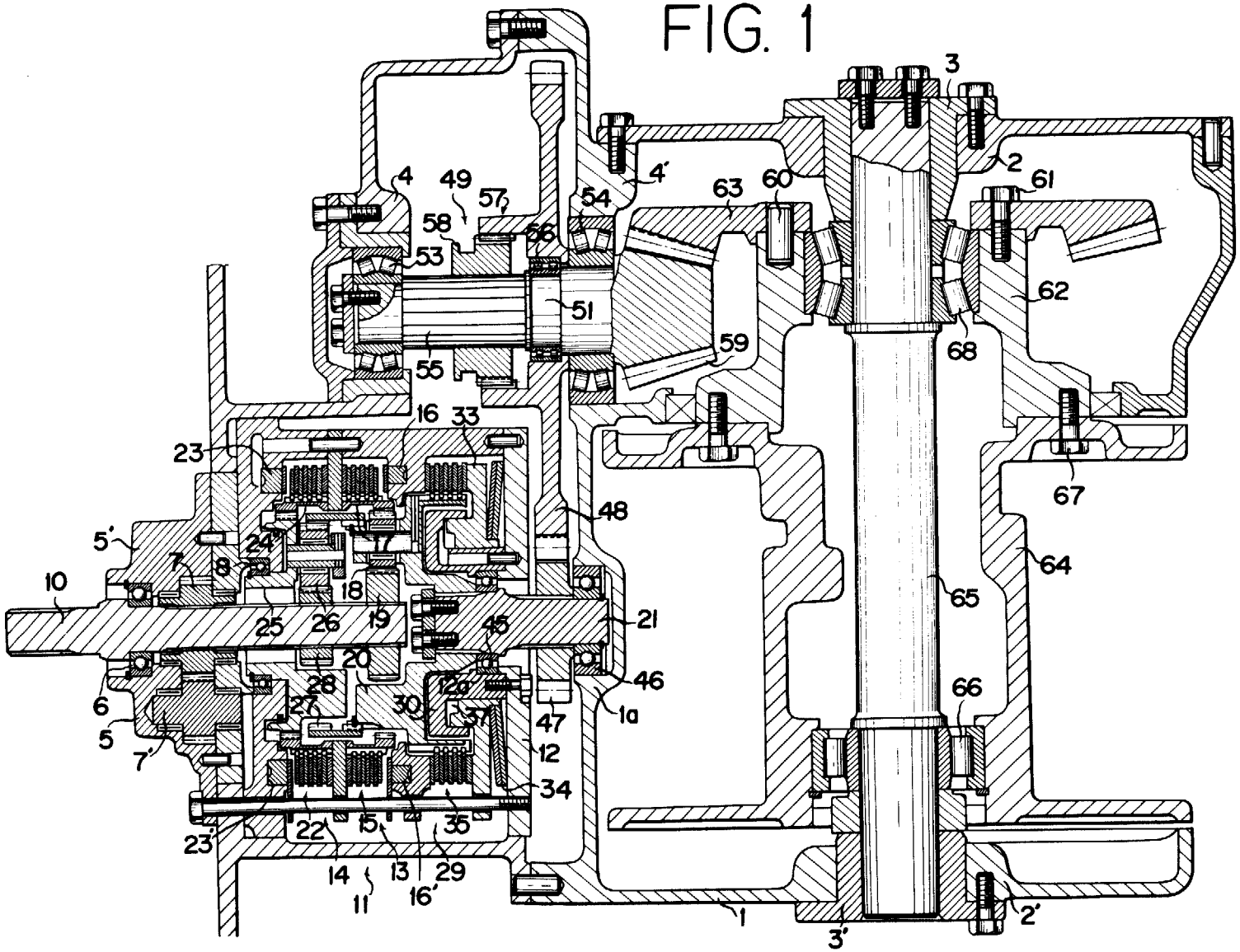
FIG. 1 is a longitudinal cross-sectional view of the present invention.

The main body 1 includes an input clutch unit 11. The input clutch unit 11 is connected with a power input shaft 10. The input clutch unit 11 includes a forward rotation clutch unit 13 and a reverse rotation or reversing clutch unit 14 each comprising a planetary gear set.

The above-mentioned power input shaft 10 is supported through a bearing 6 housed in shaft supporting portion 5' of a supporting member 5 fixedly secured to the main body 1. The power input shaft 10 has a gear 7 fixedly secured thereto which is engaged in turn with a gear 7' carried by the supporting member 5. The power input shaft 10 has sun gears 19 and 28 fixedly secured thereto. The main body 1 has a clutch housing 12 fixedly secured thereto. A planet carrier 25 is installed through a bearing 8 within the clutch housing 12. A planetary gear 26 is rotatably supported by the planet carrier 25, and the planetary gear 26 is engaged with a sun gear 28. The planet carrier 25 is engaged with a ring gear 24 which has a spline formed thereon which is engaged with an annular friction plate 22. The clutch housing 12 has a cylindrical portion 23' in which a piston 23 is slidably mounted. An output shaft 21 is rotatably carried through bearing 45 and 46 by the clutch housing 12 and a shaft bearing portion 12 of the main body 1. The output shaft 21 has a planet carrier 20 fixedly secured thereto. The planet carrier 20 has a planetary gear 18 rotatably supported thereby which is engaged with the sun gear 19 and a ring gear 17.

Further, the planet carrier 20 is engaged with a ring gear 27 which is engaged in turn with the planetary gear 26. The aforementioned ring gear 17 has a spline formed thereon which is engaged with an annular friction plate 15 of a forwardly rotating clutch unit 13. The clutch housing 12 includes also a cylindrical portion 16' in which a piston 16 is slidably mounted. The above-mentioned planet carrier 20 has a spline formed thereon which is engaged with an annular friction plate 35 of a braking means 29. The annular friction plate 35 is urged against the clutch housing 12 by a piston 33 adapted to be biased by a plate spring 34. The clutch housing 12 has a piston cage 30 fixedly secured thereto, and a pressuriged fluid chamber is formed or defined between the piston cage 30 and the piston 33. The output shaft 21 has a power transmission gear 47 fixedly secured thereto which is engaged in turn with a second power transmission gear 48.

A shaft 65 is rotatably supported through bearings 3 and 3' by shaft supporting portions 2 and 2'. The shaft 65 has a drum connecting member 62 rotatably carried through a bearing 68 thereby. One end of a drum 64 is connected to the drum connecting member 62 by means of a bolt 67. Further, the drum 64 is rotatably supported through a bearing 67 by the drum supporting shaft 65. A bevel gear 63 is attached to the drum connecting member 62 by means of a bolt 61 and a pin 60. A shaft 51 is rotatably supported through bearings 53 and 54 by shaft supporting portions 4 and 4' of the main body 1. A bevel gear 59 formed on one end of the shaft 51 is engaged with the aforementioned bevel gear 63. The shaft 51 has spline portion 55 formed thereon, and a power transmission gear 58 is mounted on the spline portion 55. The second power transmission gear 48 is rotatably carried through a bearing 56 by the shaft 51. The second power transmission gear 48 has a tooth-shaped clutch 57 formed thereon which is engaged with the power transmission gear 58. The tooth-shaped clutch 57 and the power transmission gear 58 form a jaw clutch member 49.

Figure 2:
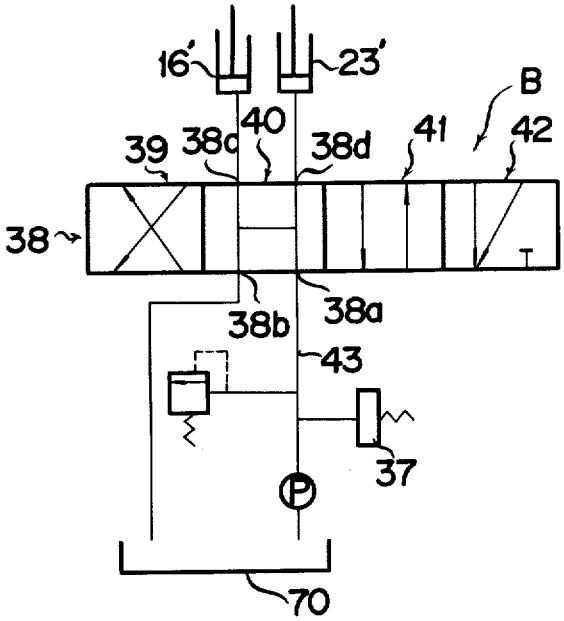
FIG. 2 is a hydraulic circuit for operating the winch of the present invention.

FIG. 2 shows an oil hydraulic circuit "B" for operating a winch. The oil hydraulic operating circuit "B" comprises a control valve 38 having for change-over positions 39, 40, 41 and 42 for forward rotation, neutral, reversing and braking, respectively. The control valve 38 includes a port 38*a* which is connected through a conduit 43 with a pump "p", and a port 38*b* which is connected with a tank 70. The pump "p" is connected to the aforementioned pressurized fluid chamber 37.

The control valve 38 includes further a port 38*c* connected to the cylinder portion 16' and a port 38*d* connected to the cylinder portion 23'.

The operation of the oil hydraulic circuit will now be described in detail.

In the control valve 38, when the changeover position 39 for forward rotation is located on the side of the port, hydraulic fluid or oil is supplied into the cylinder portion 16' so that the piston 16 can urge against the annular friction plate 15 thereby forcing them on the clutch housing 12 to render the forward rotation clutch operative. At that time, the pump "p" is driven to supply hydraulic fluid or oil into the pressurized fluid chamber 37 so that the piston 33 is moved against the baising force of the plate spring 34 thereby releasing the brake.

The activation of the forward rotation clutch 13 permits the ring gear 17 to be fixedly secured to the clutch housing 12. Consequently, rotation of the power input shaft 10 permints the sun gear 19 to rotate, and the planetary gear 18 to rotate around the sun gear 19 thereby rotating the planetary carrier 20 forwardly. As a result, the output shaft 21 is rotated; the shaft 51 is rotated through the transmission gears 47 and 48 and the jaw clutch unit 49; and the drum connecting member 62 and the drum 64 are rotated forwardly through the action of the bevel gears 59 and 63.

In the control valve 38, when the reversing changeover position 41 is located on the side of the port, hydraulic fluid or oil is supplied into the cylinder portion 23' of the reversing clutch unit 14 so that the reversing clutch 14 is rendered operative thereby allowing the ring gear 24 to be fixedly secured to the clutch housing 12. Because the planet carrier 25 is engaged with the ring gear 24, the planet carrier 25 is also fixedly secured relative to the clutch housing 12. Upon the rotation of the power input shaft 10, the sun gear 28 is rotated, and because of the planet carrier 25 being fixed the planet gear 26 is rotated around its own axis. Upon the rotation of the planet gear 26 around its own axis, the ring gear 27 is rotated by the planet gear 26 in the direction opposite to that of the sun gear 28. The rotation of the ring gear 27 permits rotation of the planet carrier 20 engaged therewith, and as a result, the output shaft 21 is rotated in the direction opposite to that of the input shaft 10. Consequently, the drum 64 is reversely rotated through the intermediate power transmission mechanism.

Further, in case it is desired to allow the winch to fall freely, the control valve 38 is changed over to the brake releasing position 42 so that the delivery pressure of the pump "p" can be applied to the chamber 37 and the piston 33 is moved thereby releasing the brake 29. In this case, the forward rotation clutch 13 and the reversing clutch 14 are of course disengaged.

It is to be understood that the foregoing description is merely illustrative of the preferred embodiment of the present invention and that the scope of the present invention is not to be limited thereto, but is to be determined by the scope of the appended claims.

What is claimed is:

1. A transmission mechanism for a winch comprising:

a housing;

an input shaft rotatably supported within said housing;

an output shaft rotatably supported within said housing, the axis of said output shaft being aligned with the axis of said input shaft;

a first planetary gear set mounted on said input shaft and adapted to rotatably connect said input shaft with said output shaft in the same direction;

a second planetary gear set mounted on said input shaft and adapted to rotatably connect said input shaft with said output shaft in the opposite direction;

braking means mounted on said output shaft, said braking means comprising a cylindrical piston cage mounted on said output shaft, a cylindrical piston mounted on said cylindrical piston cage defining a fluid chamber therebetween, a first cylindrical friction plate, and spring means disposed between said cylindrical piston and said housing, said spring means being adapted to normally urge said first cylindrical friction plate toward said housing thereby locking said output shaft against rotation; and means for selectively operating said first and second planetary gear sets by simultaneously releasing said braking means so as to transmit input rotation to said output shaft in the same or opposite direction.

2. The transmission mechanism for winch of claim 1 further including a second cylindrical friction plate fixedly mounted on said first planetary gear set, and a third cylindrical friction plate fixedly mounted on said second planetary gear set.

3. The transmission mechanism for a winch of claim 2 wherein said first planetary gear set comprises a sun gear fixedly mounted on said input shaft, a planet gear rotatably mounted on said sun gear, a ring gear rotatably mounted on said planet gear and a planet carrier connected with said planet gear, said planet carrier being fixedly mounted on said output shaft and adapted to rotate together with said output shaft about its axis; said second planetary gear set comprises a sun gear fixedly mounted on said input shaft, a planet gear rotatably mounted on said sun gear, a planetary carrier connected with said planet gear, a first ring gear mounted on said planet carrier and a second ring gear rotatably mounted on said planet gear, said second ring gear being fixedly mounted on said planet carrier of said first planetary gear set.

4. The transmission mechanism for a winch of claim 3 wherein said second cylindrical friction plate is fixedly mounted on said ring gear of said first planetary gear set, said third cylindrical friction plate is fixedly mounted on said first ring gear of said second planetary gear set and said first cylindrical friction plate is fixedly mounted on said planetary carrier of said first planetary gear set.

5. The transmission mechanism for a winch of claim 4 wherein first and second piston means are provided on said clutch housing so as to selectively fix and second and third cylindrical friction plates to said clutch housing.

* * * * *